US007455417B1

(12) United States Patent
Fan

(10) Patent No.: US 7,455,417 B1
(45) Date of Patent: Nov. 25, 2008

(54) HANDLE DEVICE WITH LIGHTING FUNCTION

(76) Inventor: Fang-Yi Fan, No. 186, Min-Kuo Rd., Chia-Yi (TW)

( * ) Notice: Subject to any disclaimer, the term of this patent is extended or adjusted under 35 U.S.C. 154(b) by 0 days.

(21) Appl. No.: 11/880,571

(22) Filed: Jul. 23, 2007

(51) Int. Cl.
*A45B 3/02* (2006.01)

(52) U.S. Cl. ..... 362/102; 362/109

(58) Field of Classification Search ..... None
See application file for complete search history.

(56) References Cited

U.S. PATENT DOCUMENTS 1,595,023 A * 8/1926 Probe ..... 362/102
5,588,735 A * 12/1996 Harada ..... 362/102
* cited by examiner

*Primary Examiner*—Anabel M Ton
(74) *Attorney, Agent, or Firm*—Curatolo & Sidoti Co., LPA; Joseph G. Curatolo; Salvatore A. Sidoti

(57) ABSTRACT

A handle device is adapted to be mounted to one end of a shaft and is adapted to accommodate a power supply unit therein. The handle device includes a handle unit adapted for accommodating the power supply unit, a coupling unit, and a lighting unit. The coupling unit is connected to one end of the handle unit, and includes a shaft clamping member adapted for clamping removably the end of the shaft so as to position the shaft on the handle unit. The lighting unit includes a lamp disposed at an opposite end of the handle unit and adapted to be connected electrically to the power supply unit accommodated in the handle unit, and a direction-adjustable connector interconnecting the lamp and the opposite end of the handle unit such that an illuminating direction of the lamp is adjustable relative to the handle unit.

6 Claims, 6 Drawing Sheets

HANDLE DEVICE WITH LIGHTING FUNCTION

BACKGROUND OF THE INVENTION

1. Field of the Invention

The invention relates to a handle device, more particularly to a handle device with a lighting function and adapted to be mounted to a shaft, such as an umbrella shaft or a walking stick.

2. Description of the Related Art

Taiwanese Patent No. M306485 discloses a multifunctional stick including a stick body, a handle unit that is disposed at one end of the stick body, and a lighting unit that is installed at the handle unit. However, since the handle unit is engaged threadedly with the stick body, if the stick body is broken, the handle unit can not be coupled to another kind of stick body that has a diameter different from that of the stick body.

A conventional lighting device for use with an umbrella is usually mounted at the tips, the ribs or the top end of the umbrella rather than the handle thereof, and functions primarily as a warning device. The conventional lighting device is not used for illumination purposes and is not designed to be separable from the umbrella.

SUMMARY OF THE INVENTION

Therefore, the object of the present invention is to provide a handle device with a lighting function and which can be easily mounted to and taken off from shafts with different sizes so that the handle device can be used as a torch even when detached from the shafts.

Accordingly, a handle device of the present invention is adapted to be mounted to one end of a shaft and is adapted to accommodate a power supply unit therein. The handle device includes a handle unit, a coupling unit, and a lighting unit. The handle unit is adapted for accommodating the power supply unit. The coupling unit is connected to one end of the handle unit, and includes a shaft clamping member adapted for clamping removably the end of the shaft so as to position the shaft on the handle unit. The lighting unit includes a lamp that is disposed at an opposite end of the handle unit and that is adapted to be connected electrically to the power supply unit accommodated in the handle unit, and a direction-adjustable connector that interconnects the lamp and the opposite end of the handle unit such that an illuminating direction of the lamp is adjustable relative to the handle unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
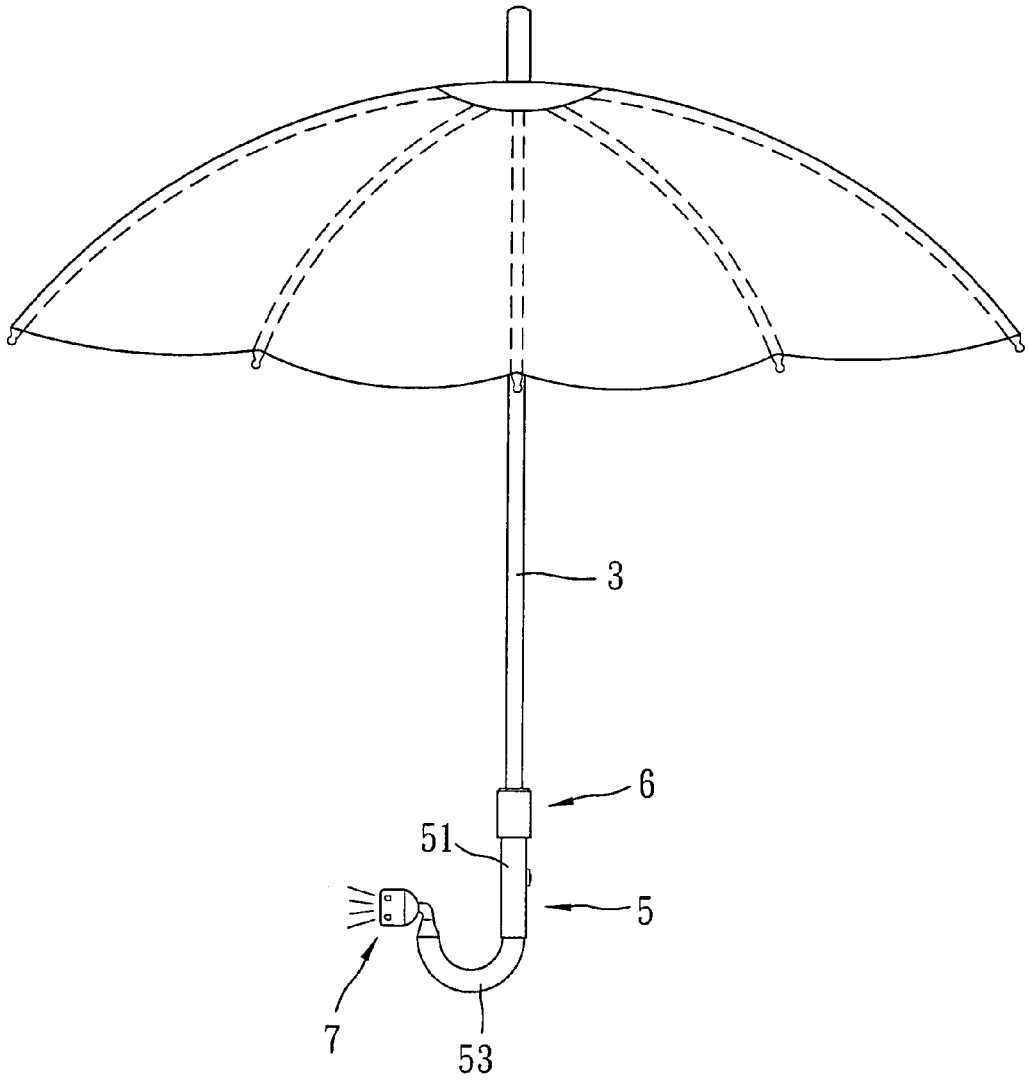
FIG. 1 is a schematic side view of a preferred embodiment of a handle device according to the invention, illustrating the handle device when coupled to an umbrella shaft.
Figure 2:
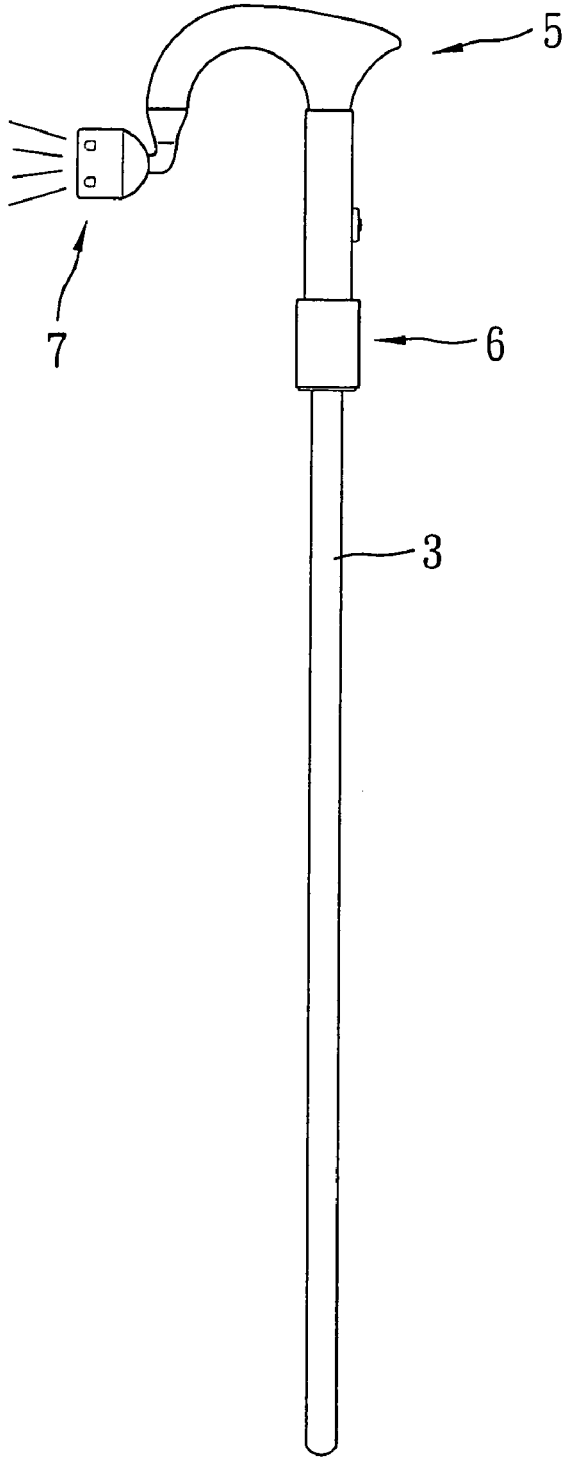
FIG. 2 is a schematic side view of the preferred embodiment, illustrating the handle device when coupled to a walking stick.
Figure 4:
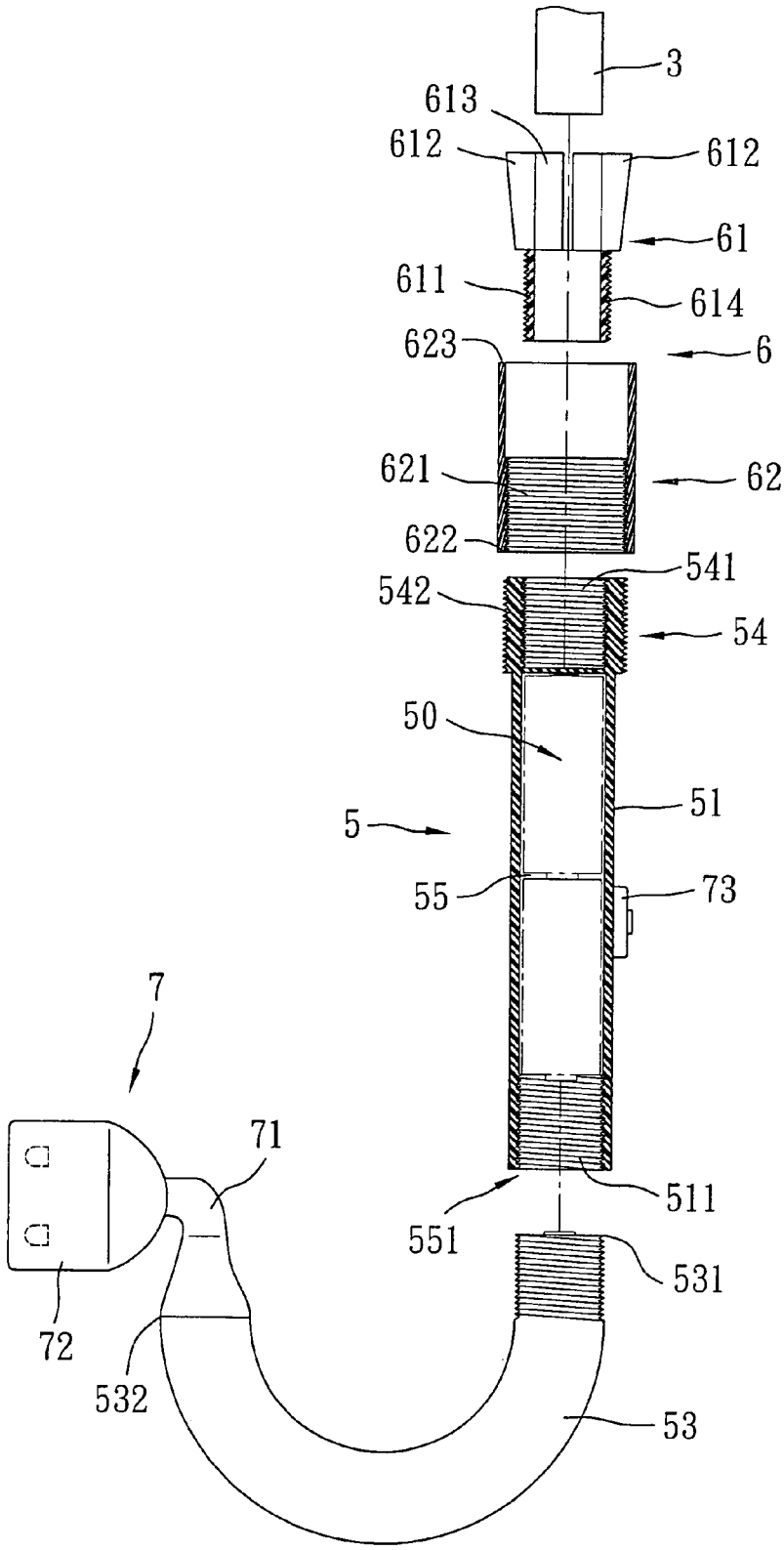
FIG. 4 is an exploded partly sectional view of the preferred embodiment.

As shown in FIG. 4, the preferred embodiment of a handle device according to the present invention is adapted to be mounted to one end of a shaft 3 and is adapted to accommodate a power supply unit 50 therein. In this embodiment, the shaft 3 is an umbrella shaft (see FIG. 1), but may be a walking stick (see FIG. 2) in other embodiments of this invention. The handle device comprises a handle unit 5 adapted for accommodating the power supply unit 50, a coupling unit 6, and a lighting unit 7.

Figure 3:
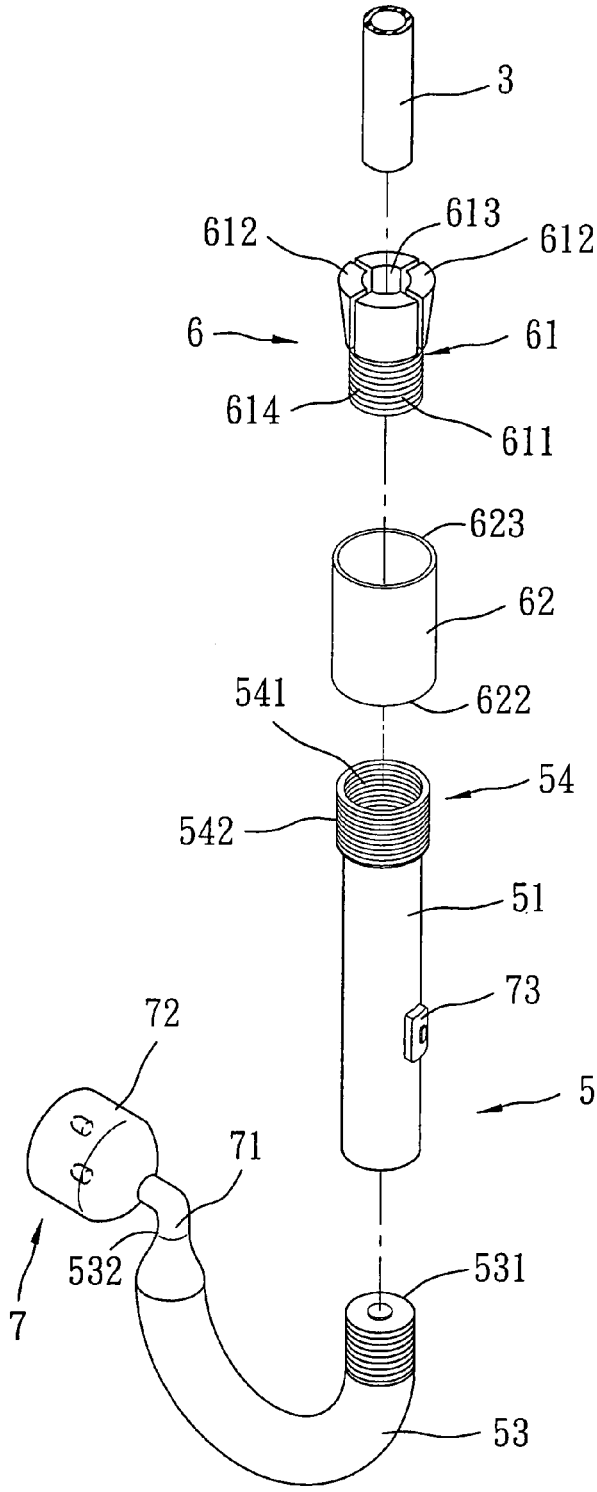
FIG. 3 is an exploded perspective view of the preferred embodiment.
Figure 5:
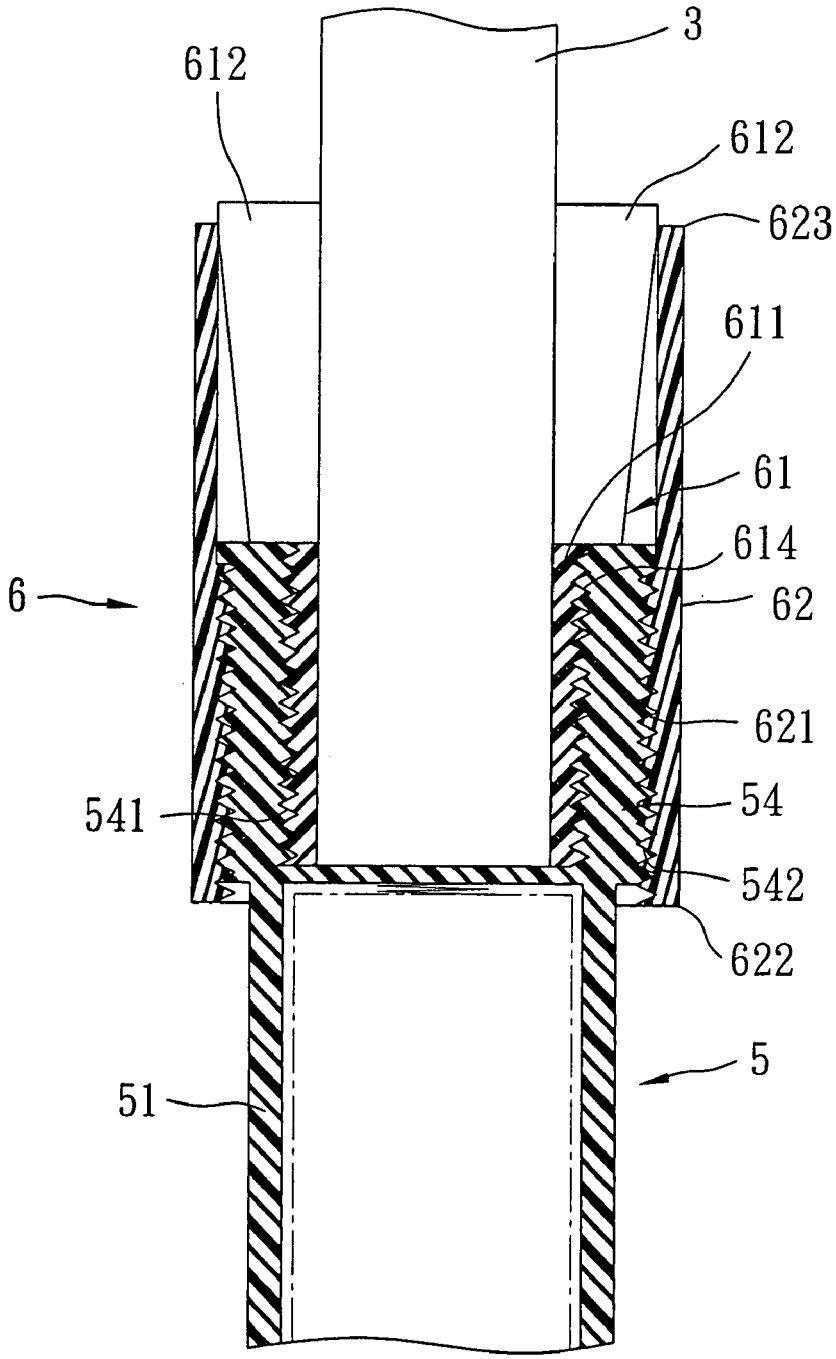
FIG. 5 is a fragmentary sectional view of the preferred embodiment, illustrating a threaded barrel sleeved on a plurality of shaft clamping claws.

As shown in FIGS. 3 to 5, the handle unit 5 has a tubular power supply section 51 adapted for accommodating the power supply unit 50, a tubular connecting section 54 extending from one end of the power supply section 51, and a curved section 53 having a first end 531 that is connected to the opposite end of the power supply section 51 opposite to the connecting section 54. In this embodiment, the power supply section 51 is formed with an interior thread 511 at the opposite end thereof, and defines a receiving space 55 that is adapted for accommodating the power supply unit 50, and that has an open end 551 closed via threaded engagement of the power supply section 51 with the first end 531 of the curved section 53. In this embodiment, the power supply unit 50 consists of a pair of batteries, and the connecting section 54 is formed with an internal thread 541 that is a right-handed thread, and an external thread 542 that is a left-handed thread.

The coupling unit 6 is connected removably to the connecting section 54 of the handle unit 5, and includes a shaft clamping member 61 adapted for clamping removably the end of the shaft 3 so as to position the shaft 3 on the handle unit 5, and a threaded barrel 62. The shaft clamping member 61 has a threaded tube portion 611 formed with a first thread 614 for threaded engagement with the internal thread 541 of the connecting section 54, and a plurality of angularly spaced apart shaft clamping claws 612 extending from one end of the threaded tube portion 611 opposite to the handle unit 5, and confining a shaft space 613 that is adapted for insertion of the end of the shaft 3. Each of the shaft clamping claws 612 has a thickness gradually increased in a direction away from the threaded tube portion 611. The threaded barrel 62 has a first barrel end 622 sleeved on the connecting section 54, and a second barrel end 623 sleeved on the shaft clamping claws 612 for urging the shaft clamping claws 612 in radial inward directions toward the end of the shaft 3 that is inserted into the shaft clamping space 613. The first barrel end 622 is formed with a second thread 621 for threaded engagement with the connecting section 54. The first thread 614 formed in the threaded tube portion 611 of the shaft clamping member 61 and the second thread 621 formed in the threaded barrel 62 are threaded in opposite directions.

The lighting unit 7 includes a lamp 72 that is disposed at a second end 532 of the curved section 53 of the handle unit 5 opposite to the power supply section 51, and that is adapted to be connected electrically to the power supply unit 50 accommodated in the handle unit 5, and a direction-adjustable connector 71 that interconnects the lamp 72 and the second end 532 of the curved section 53 such that an illuminating direction of the lamp 72 is adjustable relative to the handle unit 5.

The direction-adjustable connector 71 is a flexible metal wire or a flexible metal bellows tube covered with an insulating material in this embodiment, but should not be limited thereto. The lighting unit 7 further includes a switch 73 mounted on the power supply section 51 of the handle unit 5 and operable so as to make and break an electrical circuit between the lamp 72 and the power supply unit 50 accommodated in the handle unit 5. In this embodiment, the lamp 72 is a light emitting diode.

Figure 6:
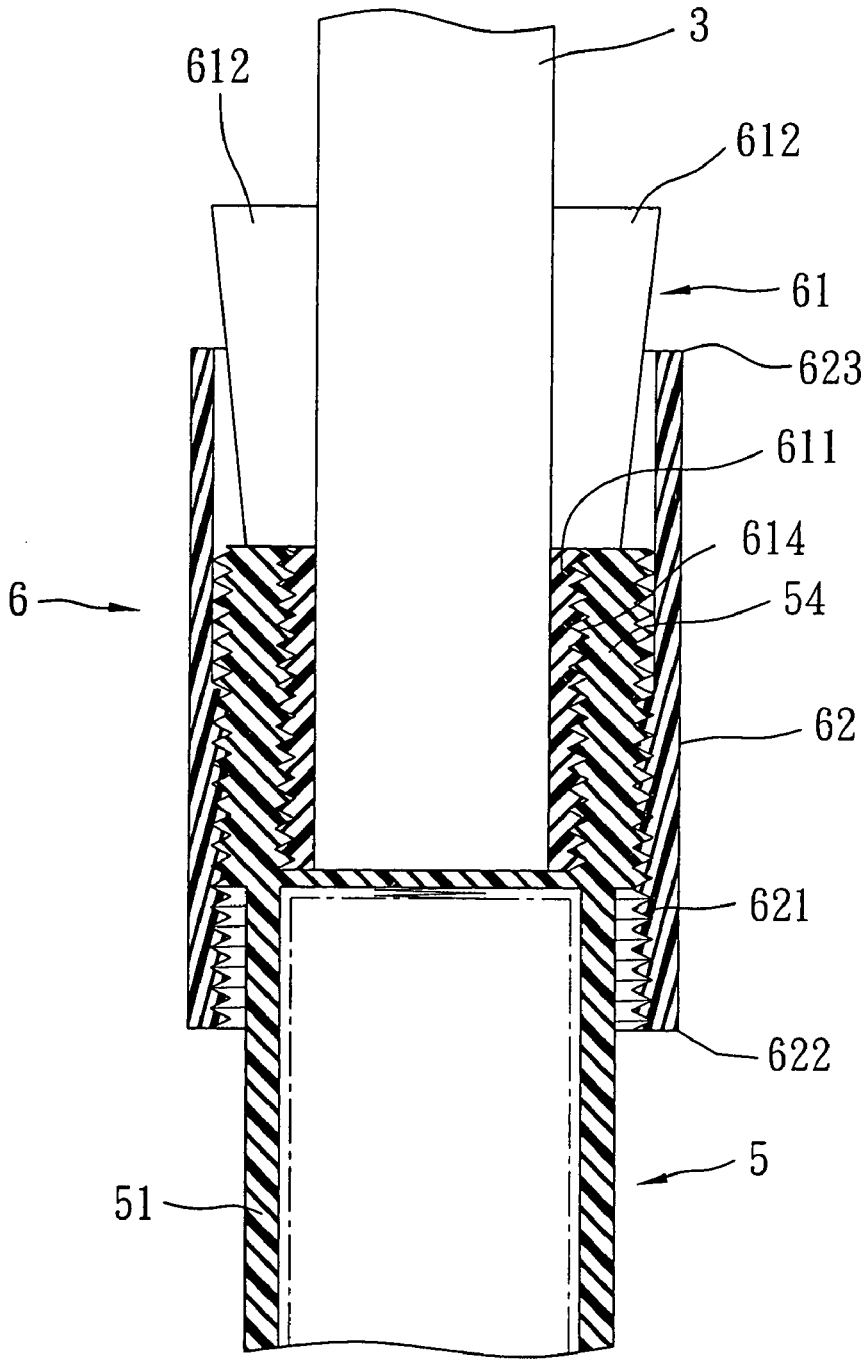
FIG. 6 is a view similar to FIG. 5, but illustrating the threaded barrel before being sleeved on the shaft clamping claws.

To couple the shaft 3 to the handle device of this embodiment, a user has to engage the threaded tube portion 611 of the shaft clamping member 61 of the coupling unit 6 threadedly into the connecting section 54 of the handle unit 5 (see FIG. 6), insert one end the shaft 3 into the shaft clamping space 613 in the shaft clamping member 61, and then rotate the threaded barrel 62 so that the first barrel end 622 is engaged threadedly with the connecting section 54, and that the second barrel end 623 is sleeved on the shaft clamping claws 612 for urging the shaft clamping claws 612 in radial inward directions toward the end of the shaft 3 that is inserted into the shaft clamping space 613 (see FIG. 5).

As shown in FIGS. 3 to 5, since the internal and external threads 541, 542 are threaded in opposite directions, when the threaded barrel 62 of the coupling unit 6 is rotated to move toward the shaft 3 via threaded engagement with the external thread 542, the shaft clamping member 61 will be driven to rotate and move in a direction opposite to the shaft 3 by virtue of the friction between the threaded barrel 62 and the shaft clamping claws 612 of the shaft clamping member 61, thereby fastening the threaded tube portion 611 of the shaft clamping member 61 in the connecting section 54. Therefore, the internal and external threads 541, 542 have to be threaded in opposite directions so as to have the abovementioned advantage of the preferred embodiment, i.e., the internal thread 541 may be a left-handed thread while the external thread 542 may be a right-handed thread in other embodiments of this invention.

Therefore, the handle device according to the present invention can be easily mounted to and taken off the shaft 3 by simply manipulating the coupling unit 6. Moreover, if the shaft 3 is disposed with one end connected to an object, the present invention can be mounted to the opposite end of the shaft 3 to serve the function of an illuminating apparatus.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A handle device adapted to be mounted to one end of a shaft and adapted to accommodate a power supply unit therein, said handle device comprising:

a handle unit adapted for accommodating said power supply unit;

a coupling unit connected to one end of said handle unit and including a shaft clamping member adapted for clamping removably said one end of the shaft so as to position the shaft on said handle unit; and a lighting unit including a lamp that is disposed at an opposite end of said handle unit and that is adapted to be connected electrically to the power supply unit accommodated in said handle unit, and a direction-adjustable connector that interconnects said lamp and said opposite end of said handle unit such that an illuminating direction of said lamp is adjustable relative to said handle unit;

wherein said handle unit has a tubular power supply section adapted for accommodating said power supply unit, and a tubular connecting section extending from one end of said power supply section and disposed opposite to said lighting unit, said shaft clamping member engaging threadedly said connecting section of said handle unit; and wherein said shaft clamping member of said coupling unit has a threaded tube portion engaged threadedly with said connecting section of said handle unit, and a plurality of angularly spaced apart shaft clamping claws extending from one end of said threaded tube portion opposite to said handle unit, and confining a shaft space adapted for insertion of said one end of the shaft, said coupling unit further including a threaded barrel that has a first barrel end sleeved on and engaged threadedly with said connecting section of said handle unit, and a second barrel end sleeved on said shaft clamping claws for urging said shaft clamping claws in radial inward directions toward said one end of the shaft that is inserted into said shaft clamping space.

2. The handle device as claimed in claim 1, wherein:

said threaded tube portion of said shaft clamping member of said coupling unit is formed with a first thread for threaded engagement with said connecting section of said handle unit;

said threaded barrel of said coupling unit is formed with a second thread for threaded engagement with said connecting section of said handle unit; and said first and second threads are threaded in opposite directions.

3. The handle device as claimed in claim 1, wherein each of said shaft clamping claws of said shaft clamping member has a thickness that is gradually increased in a direction away from said threaded tube portion of said shaft clamping member.

4. A handle device adapted to be mounted to one end of a shaft and adapted to accommodate a power supply unit therein, said handle device comprising:

a handle unit adapted for accommodating said power supply unit;

a coupling unit connected to one end of said handle unit and including a shaft clamping member adapted for clamping removably said one end of the shaft so as to position the shaft on said handle unit; and a lighting unit including a lamp that is disposed at an opposite end of said handle unit and that is adapted to be connected electrically to the power supply unit accommodated in said handle unit, and a direction-adjustable connector that interconnects said lamp and said opposite end of said handle unit such that an illuminating direction of said lamp is adjustable relative to said handle unit;

wherein said handle unit has a tubular power supply section adapted for accommodating said power supply unit, and a tubular connecting section extending from one end of said power supply section and disposed opposite to said lighting unit, said shaft clamping member engaging threadedly said connecting section of said handle unit; and wherein said handle unit further has a curved section that has a first end connected to the other end of said power supply section opposite to said connecting section, and a second end connected to said direction-adjustable connector.

5. The handle device as claimed in claim 4, wherein said power supply section of said handle unit defines a receiving space adapted for accommodating the power supply unit, said receiving space having an open end that is closed via threaded engagement of said power supply section with said first end of said curved section of said handle unit.

6. A handle device adapted to be mounted to one end of a shaft and adapted to accommodate a power supply unit therein, said handle device comprising:

a handle unit adapted for accommodating said power supply unit;

a coupling unit connected to one end of said handle unit and including a shaft clamping member adapted for clamping removably said one end of the shaft so as to position the shalt on said handle unit; and a lighting unit including a lamp that is disposed at an opposite end of said handle unit and that is adapted to be connected electrically to the power supply unit accommodated in said handle unit, and a direction-adjustable connector that interconnects said lamp and said opposite end of said handle unit such that an illuminating direction of said lamp is adjustable relative to said handle unit; and wherein said direction-adjustable connector of said lighting unit is a wire covered with an insulating material.

* * * * *